US009138378B2

(12) United States Patent
McArthur et al.

(10) Patent No.: US 9,138,378 B2
(45) Date of Patent: Sep. 22, 2015

(54) BLISTER PACKAGE AND METHOD OF FORMING SAME

(75) Inventors: Donald McArthur, Oswego, NY (US); Benjamin Davis, Columbia, SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 13/176,933

(22) Filed: Jul. 6, 2011

(65) Prior Publication Data

US 2013/0008825 A1 Jan. 10, 2013

(51) Int. Cl.

| | |
|---|---|
| ***B65D 75/36*** | (2006.01) |
| ***A61J 1/03*** | (2006.01) |
| ***B65B 61/02*** | (2006.01) |
| ***B65D 75/32*** | (2006.01) |
| ***B65D 75/58*** | (2006.01) |
| ***B65B 61/18*** | (2006.01) |
| ***B65B 9/04*** | (2006.01) |

(52) U.S. Cl.

CPC ..... *A61J 1/035* (2013.01); *B65B 9/045* (2013.01); *B65B 61/02* (2013.01); *B65B 61/18* (2013.01); *B65D 75/327* (2013.01); *B65D 75/5833* (2013.01)

(58) Field of Classification Search

USPC ..... 206/528, 531–532, 538–539, 461

See application file for complete search history.

(56) References Cited

U.S. PATENT DOCUMENTS

| | | | | |
|---|---|---|---|---|
| 2,680,558 | A | | 6/1954 | Mai |
| 3,004,697 | A | | 10/1961 | Stone |
| 3,421,615 | A | | 1/1969 | Salzer et al. |
| 3,759,371 | A | | 9/1973 | Marks |
| 3,863,834 | A | | 2/1975 | Sandford |
| 3,872,970 | A | | 3/1975 | Edison |
| 3,942,640 | A | | 3/1976 | Hellstrom |
| 3,948,394 | A | | 4/1976 | Hellstrom |
| 3,986,640 | A | * | 10/1976 | Redmond ..... 222/92 |
| 4,243,144 | A | | 1/1981 | Margulies |
| 4,294,361 | A | | 10/1981 | Margulies et al. |
| 4,317,399 | A | | 3/1982 | Romagnoli |
| 4,342,395 | A | | 8/1982 | Brown |

(Continued)

FOREIGN PATENT DOCUMENTS

| | | |
|---|---|---|
| DE | 44 02 038 A1 | 7/1995 |
| FR | 2 757 835 | 7/1998 |

(Continued)

OTHER PUBLICATIONS

Declaration of Benjamin Davis, U.S. Appl. No. 12/011,116, executed Jul. 20, 2011.

*Primary Examiner* — Anthony Stashick
*Assistant Examiner* — Robert Poon
(74) *Attorney, Agent, or Firm* — Flaster/Greenberg P.C.

(57) ABSTRACT

A blister package is defined for retaining product. The package is formed from a receptacle substrate having a planer sealing flange and at least one receptacle hollow for retaining product therein. A top layer is provided, covering the receptacle hollow with a portion overlapping and sealed to the sealing flange. A score pattern is formed in the top layer for promoting propagation of a tear upon forcing product from receptacle hollow against the top layer. The score pattern is defined by a plurality of rows of parallel straight lines aligned with the receptacle hollow. In addition, a plurality of spaced curved or bowed score lines are provided. The curved or bowed score lines transversely intersect the rows of straight lines above the receptacle hollow.

16 Claims, 6 Drawing Sheets

(56) References Cited

U.S. PATENT DOCUMENTS

| | | | | |
|---|---|---|---|---|
| 4,537,312 | A | 8/1985 | Intini | |
| 4,911,304 | A | 3/1990 | Bunin | |
| 5,014,851 | A | 5/1991 | Wick | |
| 5,091,035 | A * | 2/1992 | Anhauser | 156/701 |
| 5,150,793 | A | 9/1992 | Tannenbaum | |
| 5,172,812 | A | 12/1992 | Wharton et al. | |
| 5,310,060 | A | 5/1994 | Bitner et al. | |
| 5,339,960 | A | 8/1994 | Price | |
| 5,360,116 | A | 11/1994 | Schmiletzky | |
| 5,469,968 | A | 11/1995 | Matthews et al. | |
| 5,529,188 | A | 6/1996 | Coggswell | |
| 5,716,688 | A | 2/1998 | Burke et al. | |
| 5,791,478 | A | 8/1998 | Kalvelage et al. | |
| 5,944,191 | A | 8/1999 | Ray et al. | |
| 6,006,913 | A * | 12/1999 | Ludemann et al. | 206/531 |
| 6,212,858 | B1 | 4/2001 | Breitler | |
| 6,422,391 | B1 | 7/2002 | Swartz | |
| 6,516,949 | B2 | 2/2003 | Fuller et al. | |
| 6,637,431 | B2 | 10/2003 | Ekelius et al. | |
| 6,659,280 | B2 | 12/2003 | Paliotta et al. | |
| 7,093,716 | B2 | 8/2006 | Intini | |
| 7,188,728 | B2 | 3/2007 | Williams-Hartman | |
| 2002/0162768 | A1 | 11/2002 | Bolnick et al. | |
| 2003/0102247 | A1 | 6/2003 | Inoue et al. | |
| 2004/0175527 | A1 | 9/2004 | Shiota et al. | |
| 2005/0016134 | A1 | 1/2005 | Prebelli et al. | |
| 2005/0284789 | A1 | 12/2005 | Carespodi | |
| 2007/0227932 | A1 | 10/2007 | Bobbett et al. | |
| 2008/0073240 | A1 | 3/2008 | Bowers et al. | |
| 2008/0230432 | A1 * | 9/2008 | Bobbett et al. | 206/531 |
| 2009/0145800 | A1 * | 6/2009 | Bowers et al. | 206/532 |
| 2009/0188827 | A1 | 7/2009 | McArthur et al. | |
| 2009/0301924 | A1 * | 12/2009 | Rondeau | 206/531 |
| 2010/0072104 | A1 * | 3/2010 | Kohl | 206/531 |
| 2010/0243508 | A1 * | 9/2010 | Sekiguchi et al. | 206/531 |
| 2012/0061282 | A1 | 3/2012 | Mcarthur et al. | |

FOREIGN PATENT DOCUMENTS

| | | | |
|---|---|---|---|
| GB | 2343440 | A | 5/2000 |
| GB | 2414982 | B | 8/2007 |
| JP | 05161692 | A | 6/1993 |
| JP | 10323955 | A | 8/1998 |
| JP | 07149367 | B | 12/1998 |
| WO | WO 2005/056419 | A1 | 6/2005 |
| WO | WO 2006/012314 | A1 | 8/2007 |
| WO | WO 2007/113850 | | 10/2007 |
| WO | WO 2009/143234 | A1 | 11/2009 |
| WO | WO 2010/077797 | A1 | 7/2010 |

* cited by examiner

BLISTER PACKAGE AND METHOD OF FORMING SAME

FIELD OF THE INVENTION

The present invention relates to packaging and in particular blister packaging of the type used to retain product in a receptacle hollow. The present invention further relates to the formation of a blister package.

BACKGROUND OF THE INVENTION

Blister packages are commonly used to retain ingestible products, such as candy, gum, powders, medicine tablets and the like. This type packaging is convenient for separately securing individual product portions or doses. Each individual portion may be dispensed from the package while leaving additional portions sealed within the package. Such blister packages may also be used for non-consumable products, such as toys, hardware, etc.

US 2009/0188827 to McArthur et al shows a blister package wherein the covering layer is formed of a polymer material and is provided with a plurality of perforation formed within the covering layer. The lines form a repeating pattern substantially across the area of the blister package. This commonly assigned, McArthur publication is herein incorporated by reference.

U.S. Pat. No. 5,150,793 to Tannenbaum shows a blister package having a blister sheet surrounded by a reinforcing housing made of paper. The receptacles of the blister sheet are covered by a sealing layer, which is in part formed by metallic foil. A plurality of openings are provided in registry with the blister receptacles when the package is surrounded by the paper housing. The openings align with the dimension of the blister receptacle to define an area for forcing product through the sealing layer.

US 2005/0284789 to Carespodi shows a blister package including a backing laminate having a polymer layer, a foil layer and adhesive layers. The laminate is laser scored to assist in the push through dispensing of product from the blister receptacle.

Japanese patent publications JP 05161692 and JP 07149367 appear to describe blister packages with laser slits on a sealing layer made from a plastic film. The covering film of the sealing layer includes multiple slits, centrally positioned over a receptacle hollow.

U.S. Pat. No. 5,529,188 to Coggswell shows a blister package having a sealing layer including a plurality of crossed perforations and a plurality of perforations in a U-shaped pattern, each aligned with a receptacle hollow.

U.S. Pat. No. 5,360,116 to Schmiletvky shows a blister package with a covering layer having a perforation pattern that surrounds the periphery of the receptacle hollow to provide a means for peeling of the covering layer away from the receptacle.

SUMMARY OF THE INVENTION

A blister package is defined for retaining individual products. The package is formed from a receptacle substrate having a planer sealing flange and at least one retaining receptacle hollow formed to retain product therein. A top layer is provided, covering the receptacle hollow with a portion overlapping and sealed to the sealing flange. A score pattern is formed in the top layer for promoting propagation of a tear upon forcing product from receptacle against the top layer. The score pattern is defined by a plurality of rows of parallel, substantially straight lines preferably extending longitudinally across a portion of the top layer and aligned with the receptacle hollow. In addition, a plurality of bowed score lines are provided. The bowed score lines transversely intersect the rows of straight lines above the receptacle hollow.

In a further aspect of the blister package, the bowed score lines are positioned parallel to one another. The bowed score lines may also be formed to intersect each respective straight line at a different transverse angle. The bow of the lines may be defined by a curved apex with trailing wings. The overall shape of the bowed lines may be a continuous curve or may include straight wing portions.

In another aspect of the blister package, the top layer may be formed from a single layer of polymer film having a heat seal coating thereon. Alternatively, the top layer may be formed from a laminate material. The laminate may be formed with a heat seal coating or may have a material layer within the laminate that is compatible with the material of the sealing flange. The number of straight lines provided in the plurality of rows comprises multiple lines and preferably at least three lines. Multiple spaced bowed or curved score lines are contemplated, with at least three bowed lines being preferable. The lines are preferably equidistantly spaced from the adjacent line.

In another aspect of the invention, the blister package is defined by a receptacle substrate having a plurality of receptacle hollows positioned in a defined array, with each of the receptacle hollows formed for retaining product therein. The score pattern may extend substantially across the area of the top layer, including the receptacle hollows and the sealing flange. The score pattern preferably extends into the top layer at a depth less than the thickness of the layer. The bowed and straight lines may be formed with different depths and thicknesses.

A method of forming a blister package is also contemplated. A receptacle substrate is provided having a one or more deformable receptacle hollows formed therein and surrounded by a preferably planer sealing flange. Each receptacle hollow has an open top end that is covered by a top layer. The top layer is preferably formed of a polymer material and having a defined thickness. A plurality of substantially straight score lines are formed within the top layer and a plurality of transverse bowed score lines are formed in an intersecting pattern with the straight line pattern, with each pattern aligned with the receptacle hollow. Preferably, the straight score lines are parallel and equidistantly spaced from one another and cut to a depth that is less than the thickness of the top layer. The pattern of bowed score lines overlap with the straight lines and are also, preferably parallel to one another. The top layer with its score line pattern is sealed to the sealing flange of the substrate. The bowed lines are preferably formed on a continuous basis as the top layer moves in a machine direction. The apex of the bowed lines may be located in a forward position as the top layer moved in the machine direction with the wings portions trailing the apex. Alternatively, the apex may trail in the machine direction.

BRIEF DESCRIPTION OF THE DRAWINGS

For the purpose of illustrating the invention, there is shown in the drawings a number of forms which are presently preferred; it being understood that the invention is not limited to the precise arrangements and instrumentalities shown.

DETAILED DESCRIPTION

Figure 1:
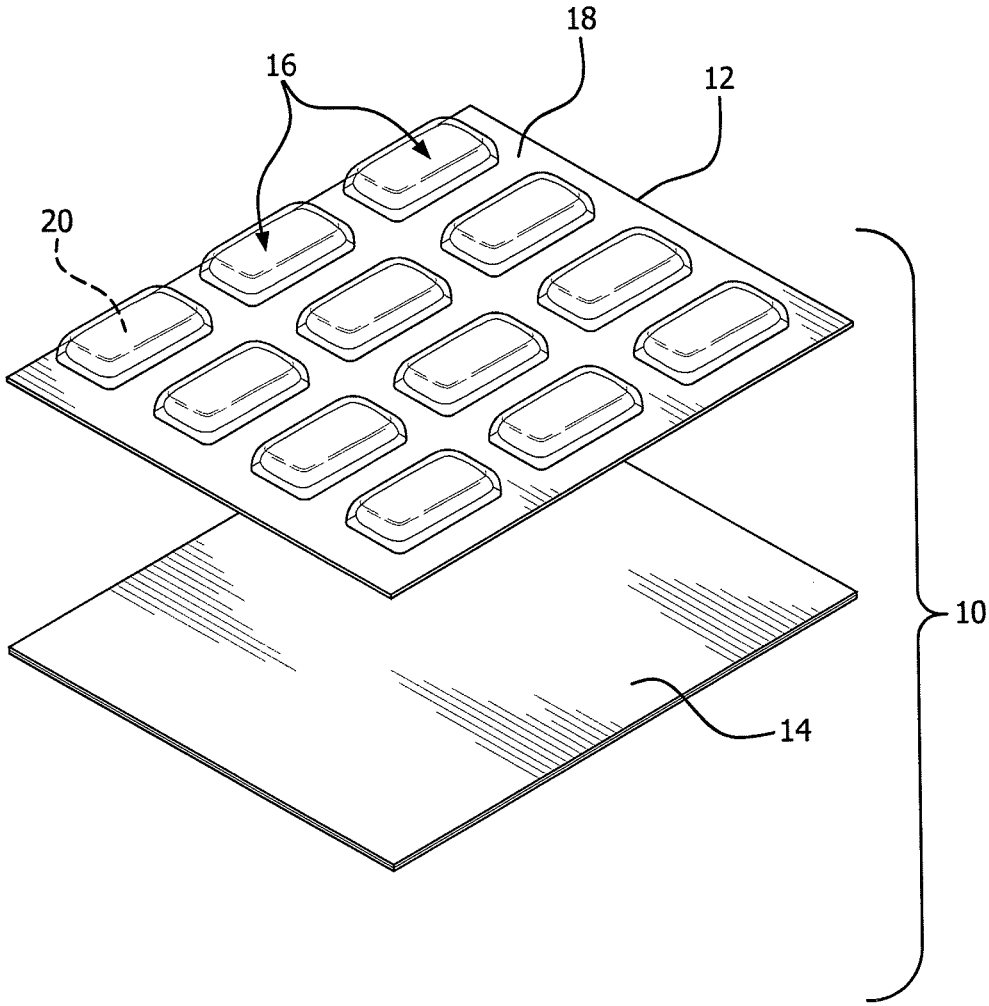
FIG. 1 is an exploded perspective view of the constituent parts of a blister package of a form presently contemplated.

Referring now to the drawings, where like numerals identify like elements, there is shown in FIG. 1 a blister package which is generally referred to by the numeral 10. In FIG. 1, the constituent parts of the blister package 10 are shown as including a receptacle substrate 12 and a top or cover layer 14. The receptacle substrate 12 includes a plurality of receptacle hollows 16 arranged in an aligned pattern or array, with each hollow 16 separated by a planer sealing flange 18. Each receptacle hollow 16 retains product 20. The blister package may be formed with any number of receptacle hollows, including a single hollow, and each hollow may retain an individual product, such as the gum tablet illustrated, multiple products or a quantity of loose product, such as a powder or granular material. A series of separation lines (not shown) may be provided within the sealing flange, between adjacent receptacle hollows, or multiple hollows, so as to permit separation of a portion of the substrate from the remainder, as desired.

Figure 2:
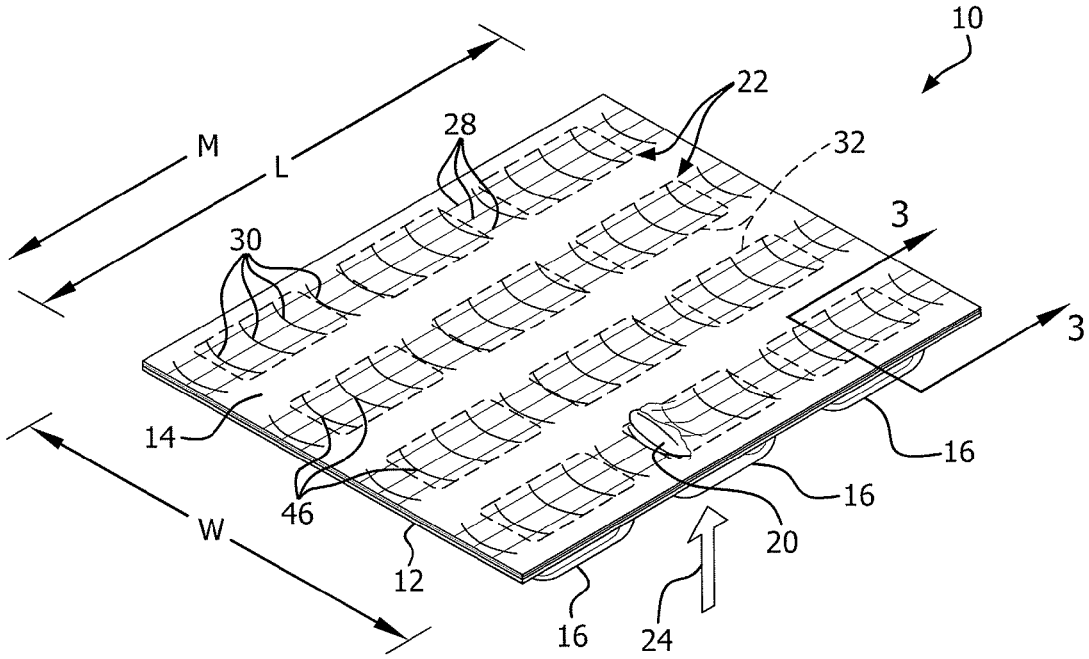
FIG. 2 is a perspective view of an assembled blister package of the type shown in FIG. 1, showing the top or cover portion of the package.

The top layer 14 is shown in FIG. 1 as separated from the receptacle substrate 12 for illustration purposes. The top layer 14 is joined to the substrate 12 in FIG. 2. As shown, the top layer 14 is joined to the sealing flange 18 such that each individual hollow 16 is covered and closed. A score pattern 22 is formed within the top layer 14. The score pattern 22 is provided for the propagation of a tear within the top layer upon the application of a force against the hollow 16 and the product 20 retained within the hollow 16. In FIG. 2, the force is represented by the arrow 24, with the resulting tear in the top layer 14 adjacent the hollow 18 releasing a previously sealed product 20.

As shown in FIG. 2, the score pattern 22 includes a plurality of rows of straight lines 28 and a further plurality of bowed lines 30. The bowed lines 30 traverse the straight lines 28 in multiple places over the area of the receptacle hollow (shown by dotted lines 32). In FIG. 2, the score pattern 22 aligned over each hollow (32) includes a pattern of three parallel straight lines 28 that are equidistantly spaced from one another and at least three parallel bowed lines 30. The pattern of straight lines 28 extends across the length L of the package 10 and, as shown, is continuous along the length of each line. The pattern of bowed lines 30 is aligned with groups of three the straight lines 28 and repeats across the longitudinal length L of the package 10. As illustrated, the bowed lines 30 are discontinuous in the width W direction of the package 10.

In the score line pattern 22 of FIG. 2, the straight lines 28 are substantially aligned with the lengthwise direction L of the package 10. It is contemplated that the number and position of lines may vary. For example, the lines may have a small curvature or other variations along their length. However, it is preferred that the lines be substantially straight. In addition, the lines 30 may be angled relative to the length of the package. The bowed lines 30 in the pattern 22 are shown as having a continuous curvature, with a curved apex and curving wings extending from the apex. As shown, the apex is curved and the wing portions carve outwardly from the apex. However, the wing portions may have other forms, and may include changes in curvature and may include straight portions. The depth of the score lines may vary, as may the number of lines and thickness of the scoring.

Figure 3:
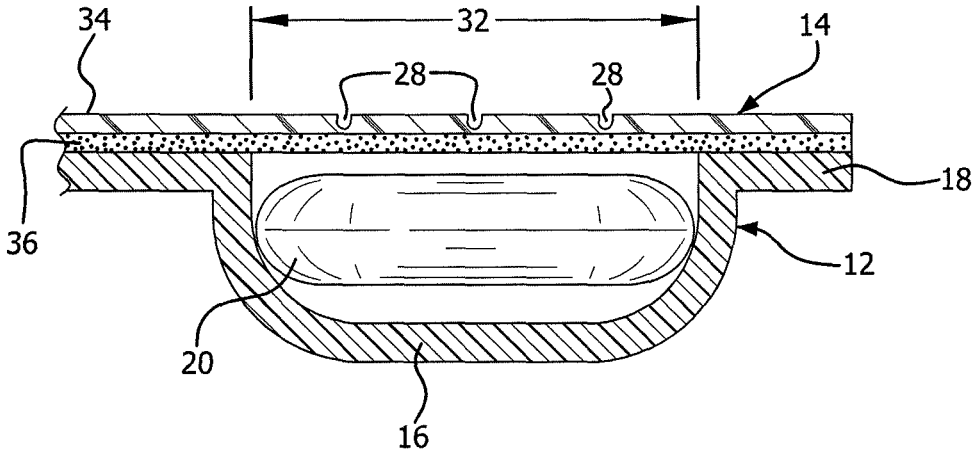
FIG. 3 is a cross sectional view of the blister package assembly of FIG. 2 as taken along lines 3-3.

In FIG. 3, the elements of a sealed receptacle hollow 16 are shown. The product 20 is positioned within a hollow 16 formed in the substrate 12. The open end 32 of the hollow 16 is covered by the top layer 14. The sealing flange 18 surrounds the hollow 16 and the top layer 14 is sealed to the flange 18. In the cross section taken, the straight lines 28 are score lines that penetrate a defined distance into the thickness of the top layer 14. The bowed lines 30 are contemplated to be similarly formed in the top layer 14. Again, variations in depth and form of the lines may be included.

As shown, the relatively outer part 34 of the top layer 14 is the structural portion of the layer and is formed of a polymer material. The second or inner part 36 of the top layer 14 as shown foams the sealing layer for attachment of the top layer 14 to the sealing flange 18. Preferably, the inner part 36 is not formed as a separate polymer layer, but is a seal coating applied to the inside surface of the outer part 34. The seal coating 36 is provided to facilitate heat sealing of the top layer 14 to the flange 18. Alternatively, the inner part 36 of the top laminate may be a separate polymer layer and may be formed as part of a laminate structure, with the inner part being compatible with the material of the sealing flange. A laminate structure may also be provided as the structural part of the top layer 14 and a separate heat seal coating may be applied on the inner surface of the laminate. As a further alternative, the top layer 14 may be secured to the flange 18 by a patterned adhesive or similar attachment mechanism. A print layer (not shown) may be provided within the structure and other layers may be included or added. It is preferred that the top layer not include a paper, foil or metal layer.

Figure 4:
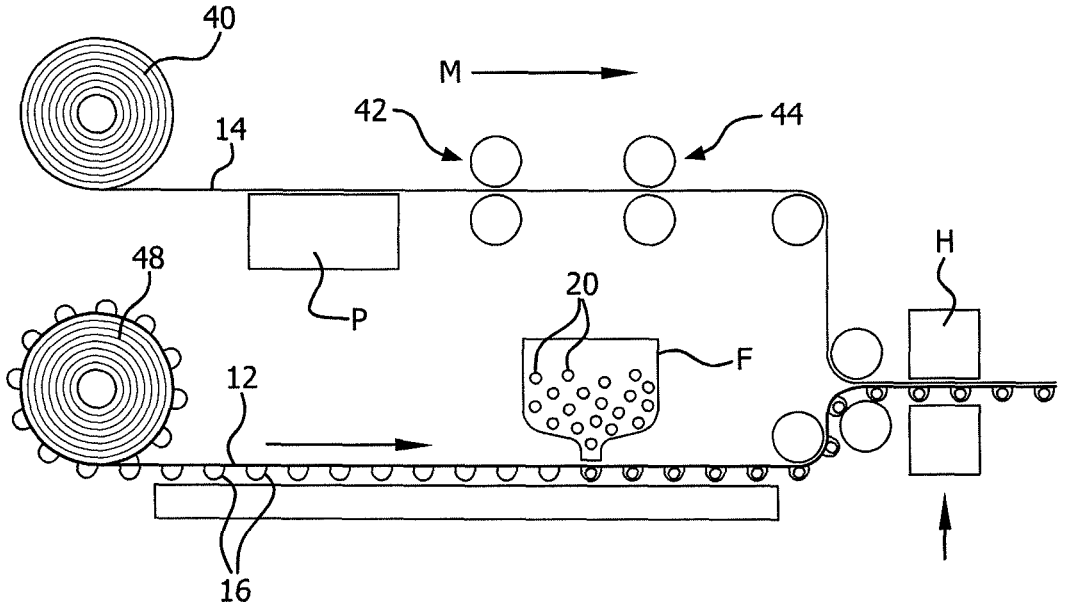
FIG. 4 is a schematic view of a blister package assembly process of a form presently contemplated.

In FIG. 4 there is schematically shown a forming and assembly process for the blister package 10. The material used to form the top layer 14 is shown in web form and is provided in a roll 40. As shown, the web is wound off of a roll 40 and is fed into a printing station P. The web may be printed on either or both surfaces. The score line pattern is separately applied to the one or both surfaces. In a first station 42, the straight line pattern (28) is formed in the web surface. The straight lines are preferably formed on a continuous basis by a rotary die cut roller, with the lines extending in the direction M of movement of the substrate in the processing machinery. A second station 44 is provided to form the bowed lines (30) in the web, with the bowed lines transversely intersecting the straight lines.

It is preferred that the two line patters be cut separately within the top layer. this separation of the cuts within the applied pattern simplifies the structures of the die cut rollers, or the like, and may also serve to reduce negative effects of the heat created during the die cutting process. The separation of the two cuts may also assists in controlling the depth and accuracy of the cuts. A uniform depth of cut serves to control the strength of the layer covering the receptacle hollows, reducing unintended break through, setting a consistent force required to expel product or reducing spoliation of product retained within the hollows.

As shown, the apex 46 (see, e.g., FIG. 2) of each bowed line 30 is formed by the initial contact of the die with the web and the trailing wings of the bow being formed during the movement of the web through the rotary cutting station 44. Hence, the apex leads the cutting operation in the machine direction M. Alternatively, the apex of one or more of the bowed score lines may be systematically foamed opposite of that shown, with the apex trailing in the machine direction. It has been found that a significant reduction in energy required to form the cut is accomplished by a systematically forming the transverse cut while the web moves in the machine direction M. As shown, each bowed line is systematically formed with an apex (46 in FIG. 2) leading the scoring, with the concave side of the cut formed after the apex as the top layer is moved in the machine direction M. A bowed scoring pattern serves to reduce noise level during the die cutting operation, as compared to a transverse straight (or similar) line having a significant portion that is aligned transverse to the machine direction. In addition, a curve at the apex has been found to provide a more precise depth of cut, as compared to a sharp edge that is produced by, for example, a V-shaped cut.

Once the score pattern is formed on the web, it is moved to be joined with the sealing flange of the substrate. The receptacle substrate 12 is shown as being provided in rolled from 48. The receptacle hollows 16 may be formed as part of the process or prior to the formation of the roll 48. The hollows 16 in the substrate 12 are filled with product 20 at a filling station F and the open end of each hollow is brought into alignment with the top layer web 14 at the heating station H (or similar station for securing the top layer to the substrate. The top layer 14 is sealed to the sealing flange (18) to close each hollow 16 (and seal the product 20 therein). The combined web and substrate is cut and separated as desired to define a package having the desired number and patter of product.

The schematic of FIG. 4 is provided to show the steps of the assembly process for a finished package. These steps may be performed together or as part of separated operations. For example, the web material forming the top layer 14 may be printed, coated and die cut as part of one operation or separate processing operations. The printed, coated and cut web, which is stored in a roll, may be slit to form narrow rolls, having a width comparable to one package. The slit rolls may then be separately sealed to the receptacle substrate, with the individual packages cut from the elongated combination. Alternatively, the slitting of the top layer may be performed at a separate time from the printing and coating operation. Other operations may be performed within this general process outline.

Figure 5:
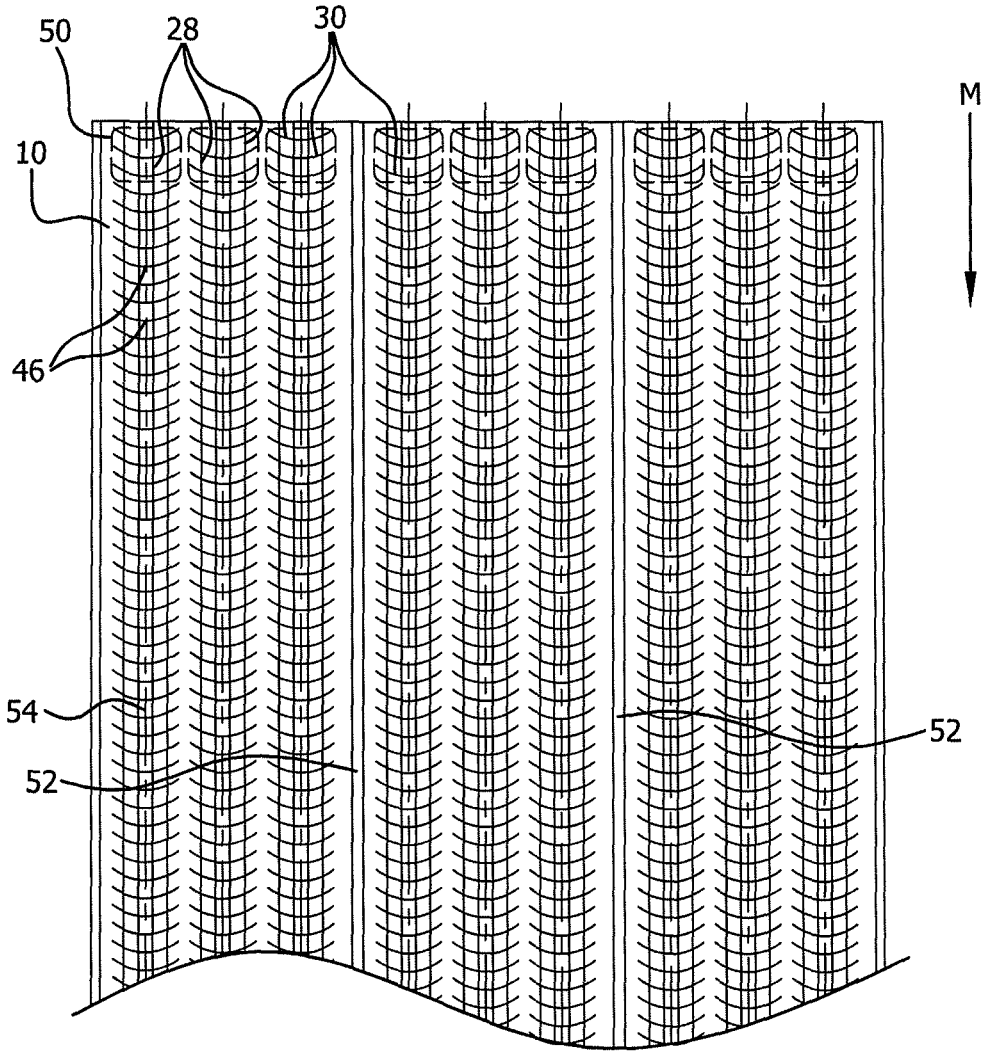
FIG. 5 is a top plan view of a score line pattern for a blister package.

In FIG. 5, a top layer web is shown with the score pattern applied. An outline 50 of the contemplated position of the receptacle hollows is also shown. The dimensional relationship as shown is such that the width of the hollow is greater that its length (measured in the machine direction M of the web). The bowed lines 30 are formed as a repeating pattern of gentle curves that are equidistantly spaced from one another. Each hollow 50 has an aligned combination of four straight lines 28 that extend in the machine direction M and three bowed lines 30. As shown, a centerline 54 is identified along each of the repeating patterns and highlights the preferred symmetrical relationship of the score pattern for each receptacle. A series of separation lines 52 are provided to mark the position for a separation cut to form the individual blister packages. A corresponding transverse cut is contemplated to further define the package arrays.

Figure 6:
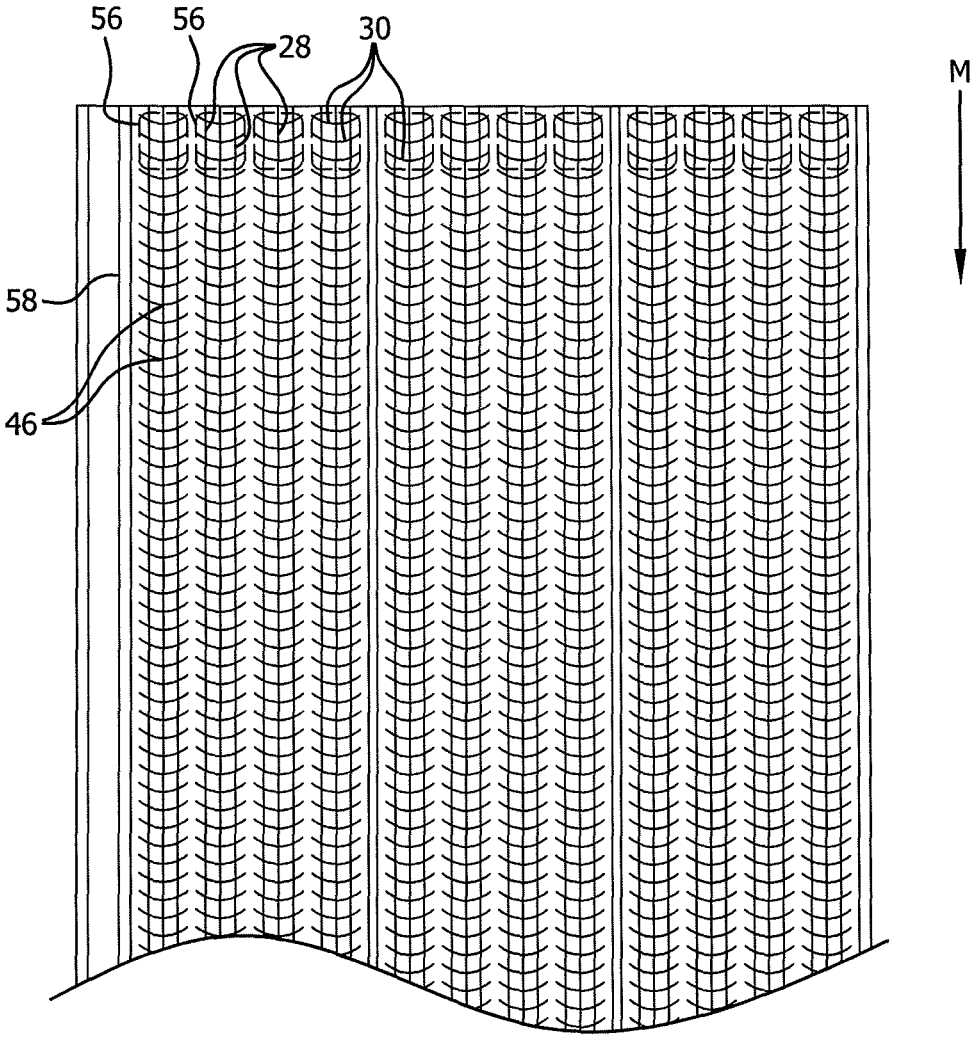
FIG. 6 is a top plan view of a further example of a score line pattern for a blister package.

In FIG. 6, a different pattern of score lines is shown for overlapping the receptacle hollows, defined by outline 56. The length (in the machine direction M) of each hollow 56 in this figure is greater than the width. There is shown three parallel, straight lines 28 that overlap the hollows 56 and three corresponding curved lines 30 transversely intersecting the straight lines 28. Separation lines 58 are shown within the pattern to define the width of an array within the defined web.

Figure 7:
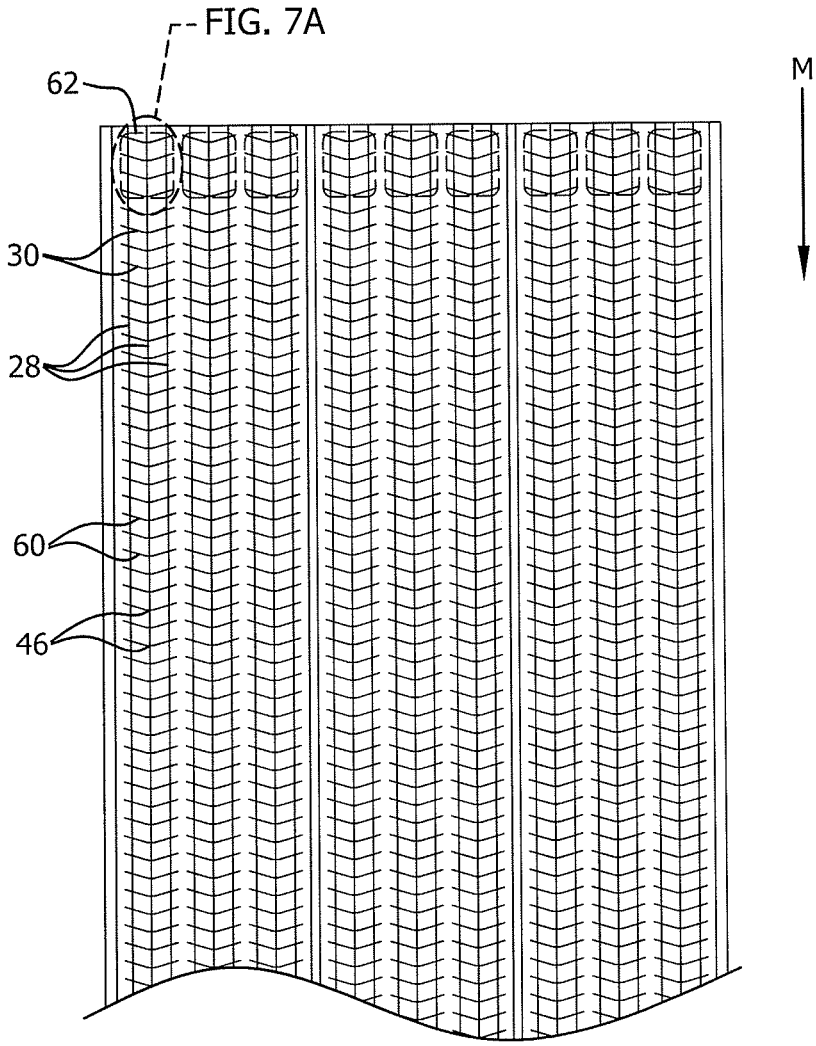
FIG. 7 is a top plan view of a still further example of a score line pattern for a blister package.
Figure 7A:
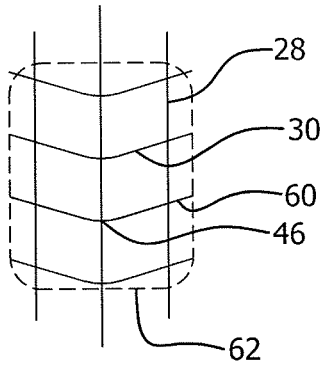
FIG. 7*a* is an enlarged view of a portion of the score line pattern shown in FIG. 7.

In FIGS. 7 and 7*a*, the bowed lines 30 are shown as having a curved apex 46 and relatively straight wings 60 extending outwardly from the apex 46. In addition, the number of bowed lines 20 per hollow 60 is increased to four, while the number of straight lines 28 remains at three.

FIGS. 5-7 are intended to show that score pattern variations for a blister package as contemplated and that further variations are possible. The score line patterns as shown may be formed by any number of known methods, including laser absorption, die cutting, heat scoring or the like. Preferably, a rotary die cutting process is utilized, so as to mechanically control the depth of cut into the outer layer. Depth of cut is one option in controlling the effectiveness of the score pattern, while at the same time maintaining the package integrity under normal handling conditions. The strength and thickness of the top layer are also factors to be used to determine the specifics of the pattern and the depth of the score lines. As generally illustrated in FIG. 3, the depth of cut is preferably part of the way through the material of the top layer. In addition, the length and number of each of the lines in the pattern may be varied as desired. For example, the straight lines may be pattern applied and aligned with the receptacle hollows (such as, being discontinuous within the area of the sealing flange). All score lines may be formed as continuous lines or by a perforation pattern having periodic spaces between scoring portions.

In the drawings and specification, there has been set forth a number of embodiments of the invention and, although specific terms are employed, these terms are used in a generic and descriptive sense only and not for purposes of limitation. The scope of the invention is set forth in the following claims.

What is claimed is:

1. A blister package for retaining individual products, the package comprising:

a receptacle substrate, the receptacle substrate having a sealing flange and at least one receptacle hollow having an open top end and formed to retain product therein, the sealing flange surrounding the open top end of the at least one receptacle hollow, and a continuous top layer covering the open top end of the at least one receptacle hollow, a portion of the top layer overlapping the sealing flange, the top layer consisting essentially of a flexible polymer film, the top layer having an upper surface and a bottom surface, the bottom surface of the top layer sealed to the sealing flange of the receptacle substrate, and a score pattern formed in at least one surface of the top layer, the score pattern formed for promoting propagation of multiple tears in the top layer upon forcing product from the receptacle hollow against the bottom surface of the top layer, the score pattern extending across and aligned with the portion of the top layer covering the at least one receptacle hollow, the score pattern defined by a plurality of rows of parallel, substantially straight score lines, the parallel rows extending across the surface portion of the top layer covering the at least one receptacle hollow, the plurality of rows of straight score lines comprise at least three lines traversing the at least one receptacle hollow, the scoring formed by each of the straight score lines extending substantially continuously between opposing portions of the sealing flange surrounding the at least one receptacle hollow, and a plurality of spaced and aligned bowed score lines extending across the surface portion of the top layer covering the at least one receptacle hollow, the scoring formed by each of the plurality of bowed score lines transversely intersecting the scoring formed by each of the plurality of rows of straight lines.

2. A blister package as in claim 1, wherein the top layer comprises a seal coat applied to the polymer material for providing a heat seal bond between the top layer and the sealing flange.

3. A blister package as in claim 1, wherein the top layer comprises a plurality of polymer layers.

4. A blister package as in claim 1, wherein the plurality of bowed curves score lines comprises at least three curved lines aligned with the at least one receptacle hollow.

5. A blister package as in claim 1, wherein the bowed score lines intersects each separate straight line within the plurality at a different transverse angle.

6. A blister package as in claim 1, wherein the straight score lines are equidistantly spaced from an adjacent straight score line.

7. A blister package as in claim 1, wherein the bowed score lines are positioned parallel to one another.

8. A blister package as in claim 1, wherein each of the bowed score lines is formed by a continuous curve.

9. A blister package as in claim 1, wherein each of the plurality of bowed score lines includes a curved apex and straight wing portions extending therefrom.

10. A blister package comprising:

a receptacle substrate, the receptacle substrate having a plurality of receptacle hollows aligned in a defined array, each of the receptacle hollows formed for retaining product therein and having an open top end, said receptacle hollows being compressible and deformable upon application of a transverse force to said hollow to cause movement of the retained product toward the top end, and a planar sealing flange surrounding each of the plurality of receptacle hollows and connecting the array of receptacle hollows;

a top layer bonded to the sealing flange and individually sealing each of the plurality of receptacle hollows, the top layer extending across the plurality of receptacle hollows formed in the substraight, the top layer formed by a flexible polymer material; and a score pattern extending substantially across the area of the top layer covering the plurality of receptacle hollows, the score pattern formed by a plurality of score lines, each extending into the top layer at a depth less than the thickness of the layer, the score lines within the score pattern formed to control the propagation of multiple tears in each portion of the top layer covering each of the individual receptacle hollows upon application of the transverse force to the retained product within the individual receptacle hollow toward the top end of the individual receptacle hollow and against the top layer portion, the score pattern repeating across the top layer within each of the plurality of receptacle hollows and including within each portion of the top layer covering each of the individual receptacle hollows a plurality of spaced, substantially straight lines formed parallel to one another in one direction across the top layer, the plurality of rows of straight score lines comprising at least three lines extending across each receptacle hollow, the scoring of each of the plurality of straight lines formed substantially continuously across the portion of the top layer between the opposing portions of the sealing flange of each receptacle hollow, and a plurality of spaced, bowed score lines aligned with one another and extending across and in a crosswise direction with respect to the plurality of straight lines, the plurality of bowed score lines each formed substantially continuously in the portion of the top layer covering each receptacle hollow, and the bowed score lines and the at least three straight lines intersecting each other in the portion of the top layer covering each receptacle hollow, and creating a plurality of scored intersections.

11. A blister package as in claim 10, wherein the top layer comprises a polymer film having a seal coat thereon.

12. A blister package as in claim 10, wherein the top layer comprises a laminate formed by multiple polymer layers.

13. A blister package as in claim 10, wherein the plurality of bowed score lines comprises at least three lines extending across each receptacle hollow.

14. A blister package as in claim 10, wherein each of the bowed score lines are curved and each intersect the straight lines extending across each receptacle hollow at a different crosswise angle.

15. A blister package as in claim 10, wherein each of the bowed score lines includes a curved apex and straight wing portions extending therefrom.

16. A blister package as in claim 10, wherein each of the plurality of rows of straight score lines are equidistantly spaced from the adjacent straight score line extending across each receptacle hollow and wherein each of the plurality of bowed score lines are equidistantly spaced from the adjacent bowed score line extending across each receptacle hollow.

* * * * *